United States Patent [19]

Seel

[11] 4,244,477

[45] * Jan. 13, 1981

[54] CONTAINER FOR POTABLE LIQUID

[76] Inventor: Jerry E. Seel, 595 Meadowbrook Dr., Adrian, Mich. 49221

[ * ] Notice: The portion of the term of this patent subsequent to Aug. 28, 1996, has been disclaimed.

[21] Appl. No.: 67,773

[22] Filed: Aug. 20, 1979

Related U.S. Application Data

[63] Continuation-in-part of Ser. No. 597,296, Jul. 18, 1975, Pat. No. 4,165,814.

[51] Int. Cl.[3] ..... B65D 51/24

[52] U.S. Cl. ..... 215/229; 220/90.2; 222/475

[58] Field of Search ..... 215/1 A, 229; 229/7 S; 220/90.2; 222/475, 530, 538, 525

[56] References Cited

U.S. PATENT DOCUMENTS

| | | | |
|---|---|---|---|
| 2,052,496 | 8/1936 | Stassi | 215/229 |
| 2,770,399 | 11/1956 | Gross | 222/475 X |
| 2,805,001 | 9/1957 | Biederman | 222/525 X |
| 2,815,879 | 12/1957 | Hermes | 215/229 X |
| 3,220,587 | 11/1965 | Griffin | 215/1 A |
| 3,253,728 | 5/1966 | De Putron | 222/525 |
| 3,298,554 | 1/1967 | Piker | 220/444 X |
| 3,684,123 | 8/1972 | Bridges | 220/444 |
| 4,165,814 | 8/1979 | Seel | 215/229 |

*Primary Examiner*—Donald F. Norton
*Attorney, Agent, or Firm*—Gifford, VanOphem, Sheridan & Sprinkle

[57] ABSTRACT

A container for a potable liquid in the form of an elongated cylinder having a screw cap with two holes secured to the top of the cylinder. The cylinder is double walled and includes an insulating material disposed between the two walls. A drinking straw passes from the liquid through one of the holes, forms a loop outside the container, and the outer end of the straw is insertable into the second hole. An annular sealing ring is provided in each hole so that the straw fits snugly in the two holes in a manner such that the loop can serve as a handle for carrying the container.

9 Claims, 3 Drawing Figures

CONTAINER FOR POTABLE LIQUID

CROSS REFERENCE

This is a continuation-in-part application of Ser. No. 597,296, filed July 18, 1975, now U.S. Pat. No. 4,165,814 entitled CONTAINER FOR POTABLE LIQUID.

BACKGROUND OF THE INVENTION

I. Field of the Invention

The present invention relates to containers for potable liquids.

II. Description of the Prior Art

Attempts have been made to provide a container for a potable liquid which is provided with a "built-in" drinking straw. Hermes in U.S. Pat. No. 2,815,879; Mainere in U.S. Pat. No. 2,837,234; and Petriccione in U.S. Pat. No. 2,844,267 each disclose a container wherein a drinking straw is positioned in the container with the suction end of the straw protected by the bottle cap. In each case access to the straw is attained by the removal of the cap or a portion thereof.

Kennedy in U.S. Pat. No. 2,052,307 describes a similar container wherein two straws are used. In this case the straws extend through the bottle cap and the ends of the straws are protected by corks, individual caps or closure elements.

Although some convenience may be gained by the type of straw described in the art it is believed the consumer needs additional utility in such structures particularly in their transportation and reuse.

My prior co-pending U.S. patent application, Ser. No. 597,296, now U.S. Pat. No. 4,165,814, discloses a potable liquid container in which a straw can be alternatively used to consume liquid within the container or as a handle to carry the container. The present invention provides an improvement to such a container.

SUMMARY OF THE PRESENT INVENTION

The present invention is a container for a potable liquid. Although the container can assume any convenient shape or size it is preferably in the form of an elongated double walled plastic cylinder provided with a screw cap, the latter having two holes therein. Each hole in the screw cap has an inwardly protruding seal ring. A drinking straw extends from near the bottom of the cylinder upwardly through one of the holes in the cap, then forms a loop, and finally passes into the second hole where the outer, or suction, end is stored. When the straw is used for drinking, the suction end is pulled out of the second hole. The seal rings on the screw cap holes provide a snug fit for the straws without unduly interfering with the insertion or removal of the straws from the cap holes.

It is a feature of the invention that when the suction end of the straw is inserted in one of the holes in the top of the container it is not only being kept clean but the loop in the straw can be used as a handle for carrying the container.

It is a further feature of the present invention that the space between the double walls of the cylinder is filled with a thermal insulating material to maintain the temperature of the liquid within the container.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
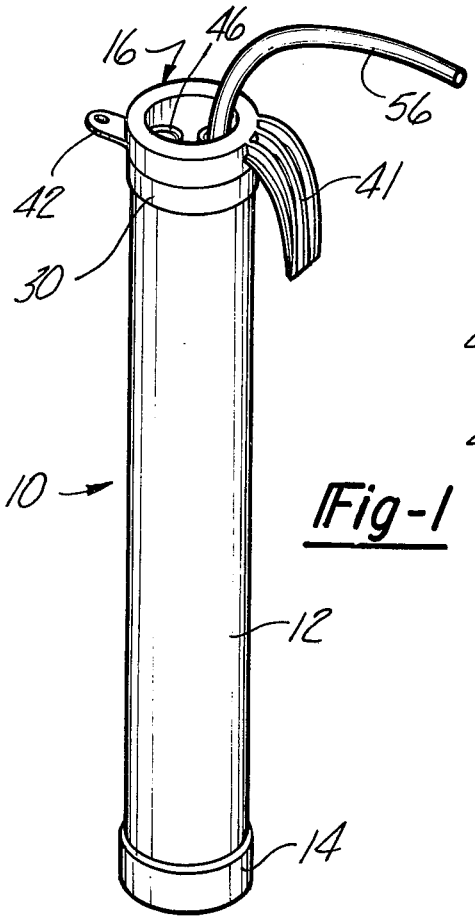
FIG. 1 is a perspective view of a container of the present invention.

Referring first to FIG. 1, the container 10 according to the present invention is thereshown and comprises an elongated and cylindrical body 12 closed at its lower end by a lower end cap 14 and at its upper end by an upper end cap 16.

Figure 3:
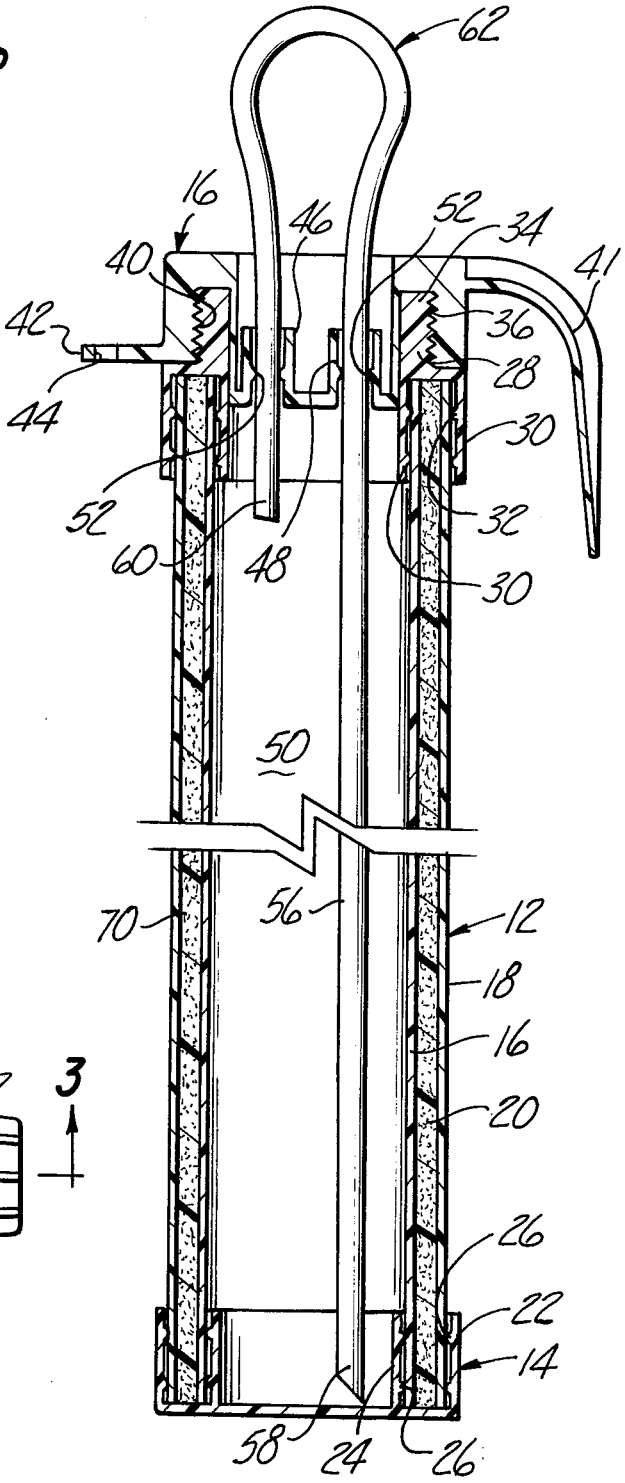
FIG. 3 is a longitudinal sectional view of the container of the present invention taken substantially along line 3—3 in FIG. 2.

Referring now to FIG. 3, the cylindrical body 12 further comprises a pair of concentric cylindrical walls 16 and 18 which are spaced from each other and thus form an annular chamber 20 therebetween and an interior body chamber 50. The lower end cap 14 also includes a pair of concentric and annular rims 22 and 24, each having a pair of axially spaced seal rings 26. The seal rings 26 which resiliently engage and are secured to the outer periphery of the outer wall 18 and inner wall 16, respectively.

Still referring to FIG. 3, the cylindrical body 12 further includes an upper housing part 28 having a pair of downwardly depending, spaced and concentric rims 30. Each rim 30 includes a pair of spaced sealing rings 32 which resiliently engage and are retained to the inner periphery of the inner wall 16 and outer periphery of the outer wall 18, respectively . The housing part 28 further includes an upwardly extending cylindrical portion 34 having external threads 36.

Figure 2:
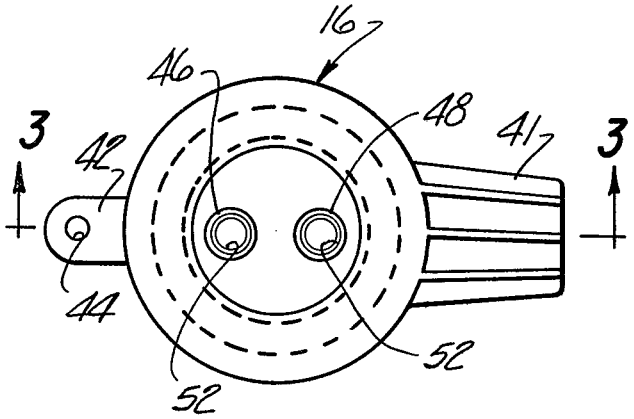
FIG. 2 is a top plan view of the container of the present invention.

Referring now to FIGS. 2 and 3, the upper end cap 16 is generally annular in shape and includes internal threads 40 which threadably cooperate with the external threads 36 on the housing part 28 so that the cap 16 can be screwed onto or off from the body 12. An outwardly protruding hook 41 is integrally formed with the cap 16 and serves as an auxiliary holding or carrying means when the container 10 is to be stored for a relatively long period of time. An outward protrusion 42 having a hole 44 is also integrally formed with the cap 16 for the same purpose.

The cap 16 encloses the upper open end of the body 12 and includes two axially extending tubular members 46 and 48 integrally formed with the cap 16 and which are open to the interior chamber 50 of the body 12. Each of the tubular members 48 includes an inwardly extending annular seal ring 52 for a reason to be subsequently described.

An elongated tubular and cylindrical straw 56 having an inner and liquid receiving end 58 and a suction end 60 is positioned through the tubular members 46 and 48 thus forming an intermediate loop portion 62. The straw 56 extends from near the bottom of the container 10, upwardly through the tubular member 48, forms the loop 62 and passes downwardly through the tubular member 46 and terminates near the top of the container 10. The straw 56 is made of any suitable material, such as extrudable plastic, and is resiliently held to the tubular members 46 and 48 by the sealing rings 52 so that the loop portion 62 can serve as a carrying handle for the container 10. However, due to the relatively small cross-sectional area of the frictional engagement between the sealing ring 52 and the tubular member 46 in the straw 62, the suction end 60 of the straw 56 can be easily removed from the tubular member 46, as shown in FIG. 1, when consumption of the liquid within the chamber 50 is desired. Similarly, reinsertion of the section end 60 of the straw 56 can be easily achieved because of the small area of frictional engagement between the sealing ring 52 and the straw 56.

The annular chamber 20 formed between the housing walls 16 and 18 is preferably filled with a thermal insulating material 70. The insulating material thus serves to surround the chamber 50 and maintain the liquid contained within the chamber 50 at its original temperature, whether hot or cold.

From the foregoing it can be seen that the container 10 for potable liquids of the present invention is advantageous in that the straw 56 can be alternatively used as a handle 62 for carrying the container or for consuming the liquid within the container. Moreover, upon removal of the suction end 60 from the tubular member 46, the throughbore of the tubular member 46 forms a vent opening for the container 10.

Having described my invention, however, many modifications thereto will become apparent to those skilled in the art to which it pertains without deviation from the spirit of the invention as defined by the scope of the appended claims.

I claim:

1. In a container for a potable liquid, the improvement comprising:

an elongated and tubular body having a top and a lower end;

means for closing the lower end of the body;

a cap closing the top of said body and said cap being provided with a first hole and a second hole each extending completely through said cap, said cap further including an annular seal ring which protrudes radially inwardly into each of said holes in the cap; and a straw extending through said first hole with a first end positioned adjacent the bottom of said container and said straw having a second end detachably received in said second hole, said straw being removable from said holes whereby said second end of said straw can be removed from said second hole to permit a person to drink the liquid contained within the container through said straw but said straw being constructed of a sufficiently strong material and fitting within said holes and engaged by seal rings with sufficient frictional engagement to support a container full of potable liquid when the ends of said straw are positioned in said holes so that said straw can be used as a handle to carry said container.

2. The invention as defined in claim 1 wherein said body further comprises a pair of coaxial wall sections which are spaced apart and form a chamber therebetween, said chamber being filled with a thermal insulating material.

3. The invention as defined in claim 2 wherein said body is tubular and cylindrical in shape.

4. The invention as defined in claim 1 wherein said body includes a threaded housing part which threadably cooperates with a threaded portion on said cap to secure said cap to said body.

5. The invention as defined in claim 1 wherein said cap includes a hook integrally formed with it.

6. The invention as defined in claim 1 wherein said seal rings are integrally formed with said cap.

7. The invention as defined in claim 1 wherein said cap includes a pair of longitudinally extending tubular members through which said cap holes are formed.

8. In a container for a potable liquid, the improvement comprising:

an elongated and tubular body having a top and a lower end;

means for closing the lower end of the body;

a cap closing the top of said body and said cap being provided with a first hole and a second hole each extending completely though said cap;

said body further comprising a pair of walls which are spaced apart from each other and form an annular chamber therebetween, said annular chamber being filled with a thermal insulating material; and a straw extending through said first hole with a first end positioned adjacent the bottom of said container and said straw having a second end detachably received in said second hole, said straw being removable from said holes whereby said second end of said straw can be removed from said second hole to permit a person to drink the liquid contained within the container through said straw but said straw being constructed of a sufficiently strong material and fitting within said holes with sufficiently frictional engagement to support a container full of potable liquid when the ends of said straw are positioned in said holes so that said straw can be used as a handle to carry said container.

9. The invention as defined in claim 8 wherein said walls are cylindrical and concentric with each other.

* * * * *